US007694932B1

(12) United States Patent
Ngan

(10) Patent No.: US 7,694,932 B1
(45) Date of Patent: Apr. 13, 2010

(54) COMBINATION DESK ACCESSORY AND PICTURE AND CALENDAR DISPLAY EASEL

(76) Inventor: Chi Lung Ngan, 5 Bradford Rd., Edison, NJ (US) 08820

( * ) Notice: Subject to any disclaimer, the term of this patent is extended or adjusted under 35 U.S.C. 154(b) by 216 days.

(21) Appl. No.: 11/806,126

(22) Filed: May 30, 2007

(51) Int. Cl.
*A47B 97/04* (2006.01)
*B65D 5/52* (2006.01)

(52) U.S. Cl. ..... 248/461; 248/459; 40/107; 40/120; 206/45.2; 206/45.28

(58) Field of Classification Search ..... 248/461, 248/460, 459, 456, 450, 447, 444.1, 441.1; 40/358, 122, 120, 905, 107; 108/1; 206/214, 206/371, 561, 760, 45.26, 45.23, 756, 45.2, 206/1.5, 45.24, 45.28; D6/761
See application file for complete search history.

(56) References Cited

U.S. PATENT DOCUMENTS

| | | | | | |
|---|---|---|---|---|---|
| 377,335 | A | | 1/1888 | Smith | |
| 1,347,839 | A | * | 7/1920 | Coons | 206/45.23 |
| 1,463,210 | A | | 7/1923 | Harris | |
| 1,641,600 | A | | 9/1927 | Ormond | |
| D90,769 | S | * | 9/1933 | Kamen | D19/36 |
| 1,939,824 | A | * | 12/1933 | Mix et al. | 206/45.23 |
| 2,076,683 | A | * | 4/1937 | Tharp | 206/730 |
| 2,301,692 | A | * | 11/1942 | Forca | 248/452 |
| 2,443,645 | A | | 6/1948 | Turan | |
| 2,892,275 | A | | 6/1959 | Woofter | |
| 2,962,825 | A | * | 12/1960 | Bravo et al. | 40/367 |
| 2,992,500 | A | | 7/1961 | Hayhow | |
| 3,408,126 | A | * | 10/1968 | Mortensen | 312/183 |
| 4,420,270 | A | * | 12/1983 | Rossello | 402/76 |
| 4,538,861 | A | * | 9/1985 | Hughes, Jr. | 312/244 |
| 4,544,123 | A | * | 10/1985 | Peacock | 248/460 |
| 4,765,462 | A | * | 8/1988 | Rose, Jr. | 206/760 |
| 4,886,166 | A | * | 12/1989 | Bankier et al. | 206/308.3 |
| 4,948,034 | A | | 8/1990 | Rohloff | |
| 5,046,273 | A | * | 9/1991 | Virvo | 40/571 |
| 5,480,118 | A | | 1/1996 | Cross | |
| 5,855,351 | A | * | 1/1999 | Cziraky et al. | 248/451 |
| 6,045,108 | A | | 4/2000 | Cziraky | |
| 6,588,128 | B2 | | 7/2003 | Whang | |
| 6,886,689 | B2 | * | 5/2005 | Hohns et al. | 206/308.3 |
| 6,925,739 | B1 | * | 8/2005 | Cole et al. | 40/120 |
| 7,178,778 | B2 | * | 2/2007 | Lee | 248/459 |
| 2003/0163936 | A1 | | 9/2003 | Floss et al. | |
| 2003/0217487 | A1 | | 11/2003 | Doss | |

* cited by examiner

*Primary Examiner*—Anita M King
(74) *Attorney, Agent, or Firm*—Shlesinger, Arkwright & Garvey LLP

(57) ABSTRACT

A combination desk accessory tray and picture and calendar display easel with a tray cover having a first tray cover position, a second display item loading and unloading position, and a third easel position.

17 Claims, 5 Drawing Sheets

COMBINATION DESK ACCESSORY AND PICTURE AND CALENDAR DISPLAY EASEL

FIELD OF THE INVENTION

This invention pertains to a combination desk accessory tray and picture and calendar display easel in which the tray cover has three positions including a cover position, a display loading and unloading position, and an easel position. It also includes a magnetic device for maintaining metallic items in the tray.

BACKGROUND OF THE INVENTION

Smith U.S. Pat. No. 377,335 shows an early office tray including a displayed calendar.

Ormond U.S. Pat. No. 1,641,600 shows a desk calendar and index tray combination with a folding cover for the tray.

Turan U.S. Pat. No. 2,443,645 shows a foldable blank for picture display in an easel form.

Woofter U.S. Pat. No. 2,892,275 shows a pocket-type calendar with a writing instrument positioned at the bottom of the calendar and having plural windows for the calendar and picture.

Hayhow U.S. Pat. No. 2,992,500 shows an easel mounted calendar of a foldable variety.

Rohloff U.S. Pat. No. 4,948,034 shows a pocket-type display device on a calendar.

Cross U.S. Pat. No. 548,118 shows a foldable easel display mount as does Cziraky U.S. Pat. No. 6,045,108.

Whang U.S. Pat. No. 6,588,128 shows a easel-type calendar.

Floss et al. publication US 2003/0163936 and Doss US 2003/0217487 show calendars with storage capabilities.

None of the earlier developments show a combination desk accessory tray and picture and calendar display easel with a tray cover foldable in one position and capable of being loaded and unloaded in another position with a third position for providing an easel having front and rear display windows.

OBJECTS AND SUMMARY OF THE INVENTION

It is an object of this invention to provide a desk accessory which includes a tray and a foldable display easel for pictures, calendars and the like.

A further object of this invention is to provide a combination desk accessory which is compact and does not take up a great deal of space on any desk or table or the like.

A further object of this invention is to provide a multipurpose desk accessory which has magnetic means for holding metal devices such as paper clips, thumb tacks, and staples which will prevent spilling if the desk accessory is accidentally hit.

Yet a further object of this invention is to provide a combination desk accessory which is attractive yet economical in construction and readily manufactured.

Still another object of this invention is to provide a combination desk accessory which may be inexpensively shipped in quantities without taking up a great deal of space.

Still a further object of this invention is to provide a combination desk accessory having an easel which has windows on two sides for positioning on a desk so that the person sitting at the desk and a customer sitting in front of the desk can observe a picture or calendar or the like.

Another object of this invention is to provide a combination desk accessory which permits ease in erecting and positioning the easel.

Still a further object of this invention is to provide a combination desk accessory which provides pockets readily accessible for insertions of material to be displayed in the windows of the easel.

These and other objects of the invention will be apparent from the following description including the drawings which are as follows:

BRIEF DESCRIPTION OF THE DRAWINGS

FIGS. 1-7

The drawing show a desk accessory D having a cover C and a tray T. The cover C consists of a bottom panel 2, side panel 4, first cover panel 6 and a second cover panel 8. As shown in FIG. 2, the first cover panel 6 and the second panel 8 may have more than one window 10. A backing sheet 12 is sealed at the bottom and sides and forms a pocket P for receiving viewable items in the window 10 such as calendars or photo information 14.

The cover C may be made from paper, cardboard or plastic, but a laminate is preferred with an outer layer of a durable plastic material and the inner layer of a paper product such as cardboard or the like. As shown in FIG. 3A, the second cover panel 8 is bonded to the backing 12. This is also true of the pocket P on the first cover panel 6. In FIGS. 5, and 6, the tray T has rear facing partitions 28 and side facing partitions 30 and 32. The tray front 18 includes an access opening 34 and the rear facing partition 28 includes an access opening 36. The area surrounded by front wall 18 partitions 30 and 32 and partition 28 is designed to receive a stacking of note paper and the access openings 34 and 36 are provided to make it easy for finger removal of sheets of note paper. The side compartments M and N are available for receipt of metallic items such as paper clips and thumb tacks and are provided with at least one magnet G mounted in the bottom of the tray T. This is best shown in FIG. 6. An additional compartment Q is provided in the tray T behind the rear facing partitions 28 for holding items such as rubber bands or staples and the like. In the walls 22 and 24 in partitions 30 and 32 notches 38, 40, 42, and 44 are provided for positioning the second cover panel 8 in an easel position with first cover panel 6 as best shown in FIG. 3. In front of notches 40 and 42 are grooves 46 and 48 for receiving a pencil, pen or the like. The tray T is provided with a lip 50 which extends from the side walls 22 and 24 to the tray front 18.

The bottom 16 of the tray and the tray rear 20 are sealed to the cover C.

Figure 1:
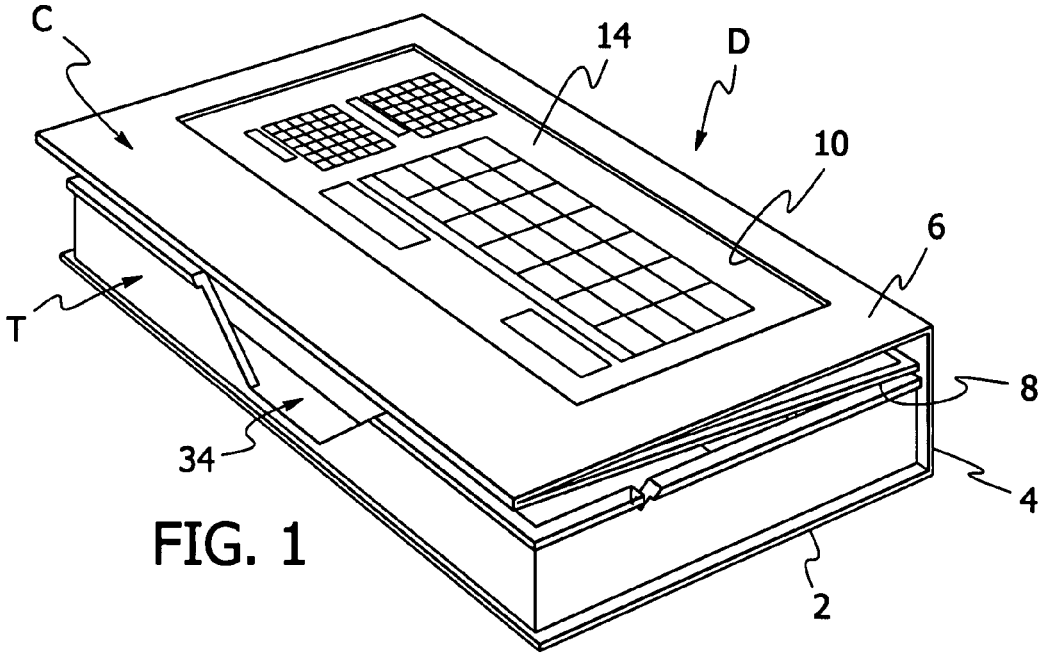
FIG. 1 is a perspective view of the desk accessory with the cover panels in cover position.
Figure 3:
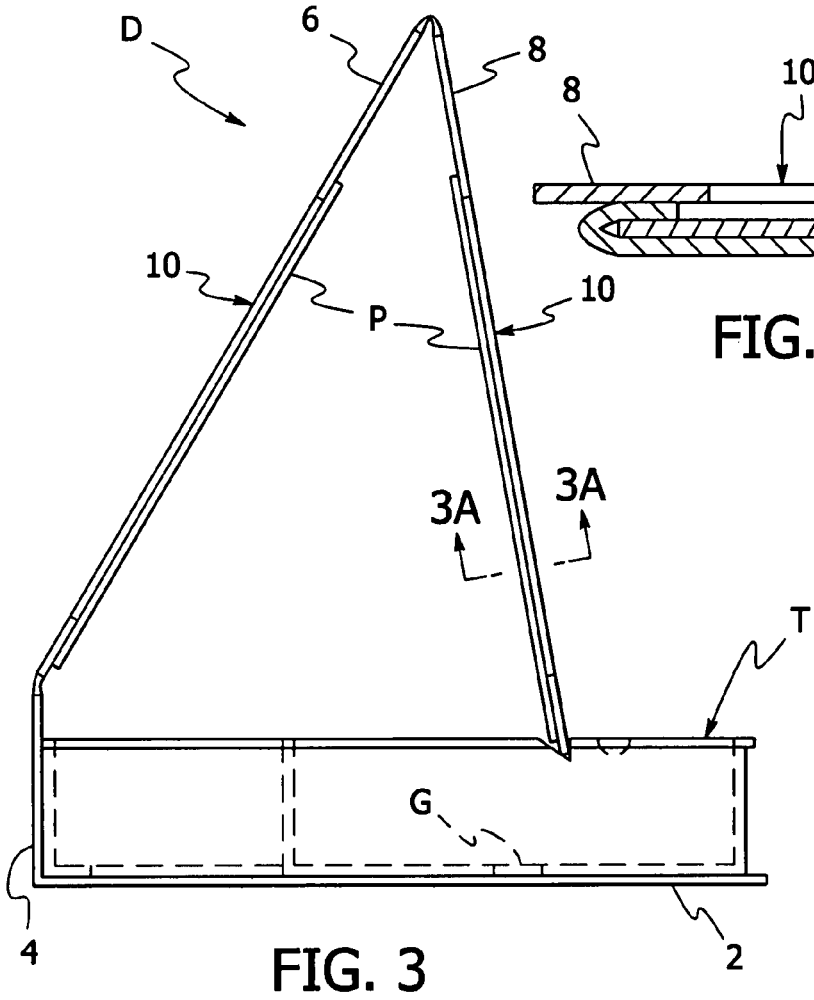
FIG. 3 is a side elevation view showing the desk accessory in easel position with portions shown in phantom lines.
Figure 3A:
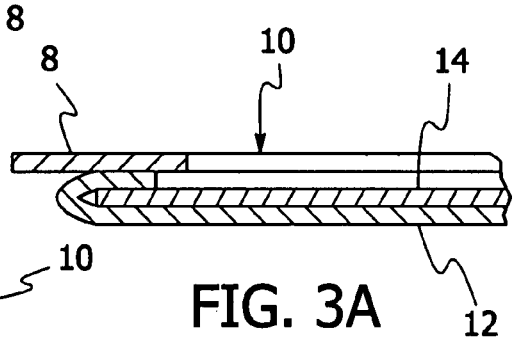
FIG. 3*a* is a cross sectional view taken along the line of 3*a*-3*a* in FIG. 3 and viewed in the direction of the arrows.
Figure 2:
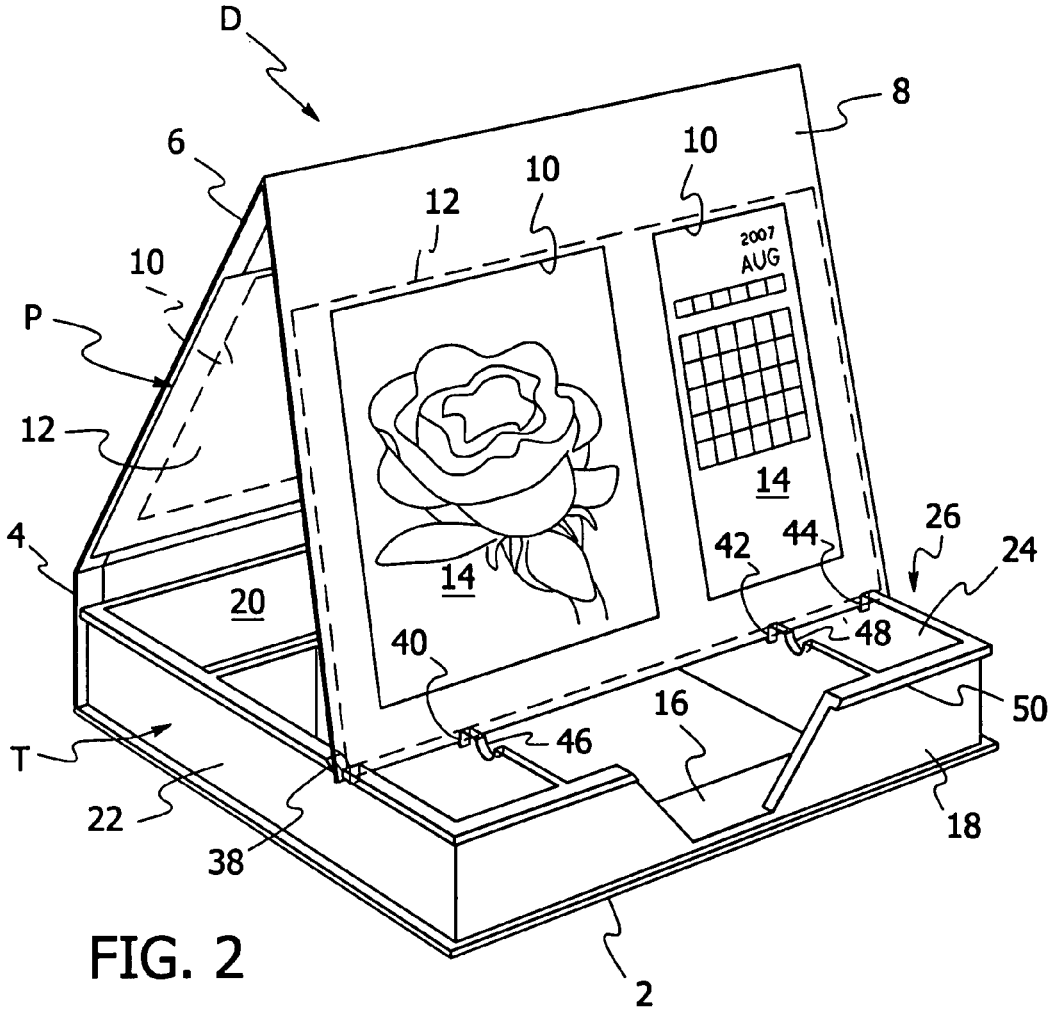
FIG. 2 is a perspective view portions shown in hidden lines of the desk accessory shown in easel position.
Figure 4:
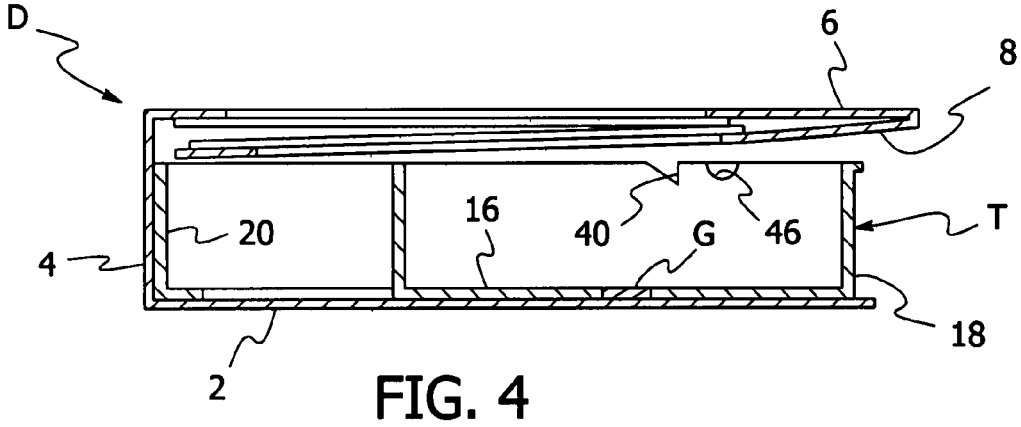
FIG. 4 is a cross sectional side elevational view.
Figure 5:
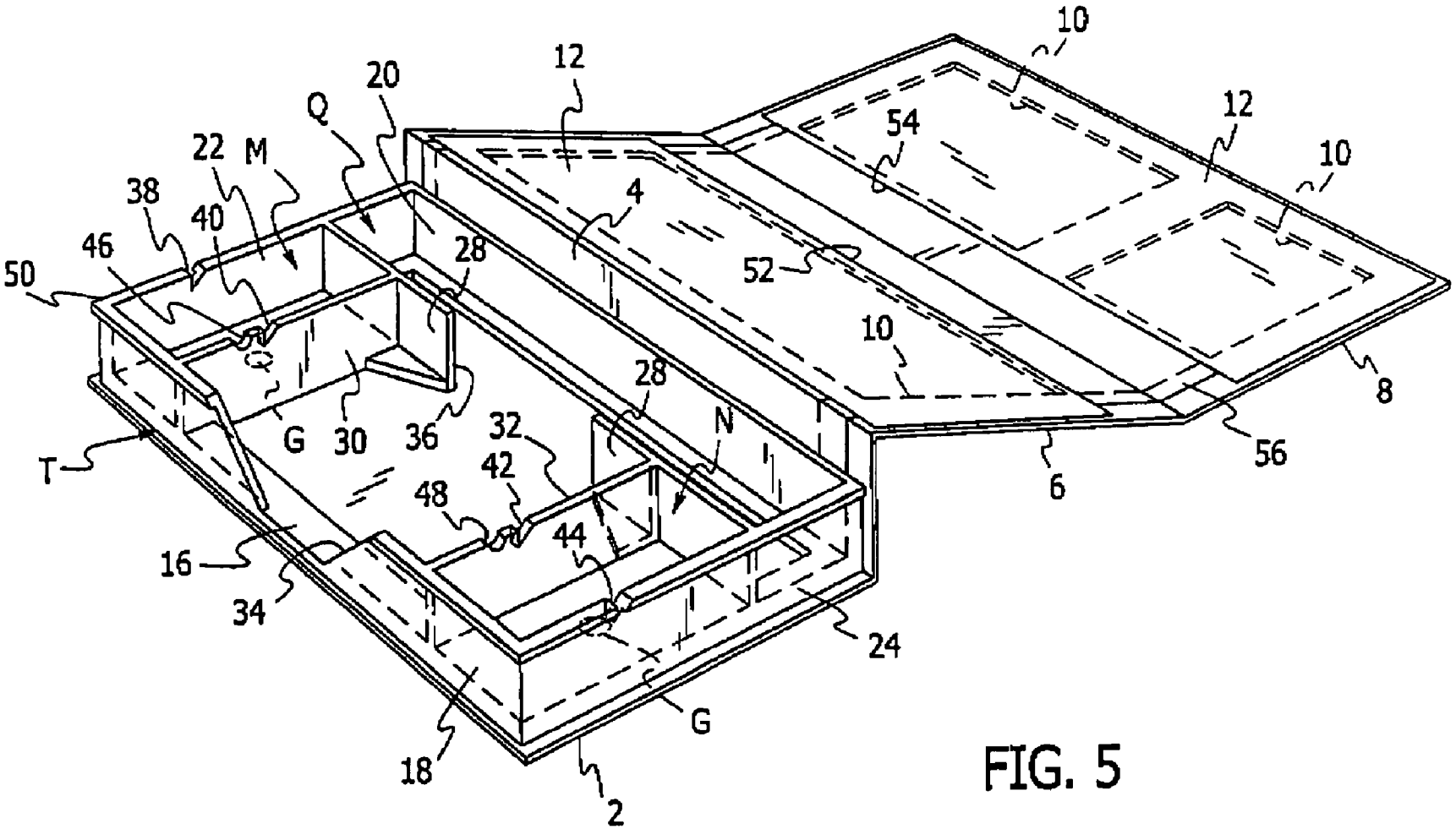
FIG. 5 is a perspective view showing the desk accessory in item loading and unloading position with portions shown in phantom lines.
Figure 6:
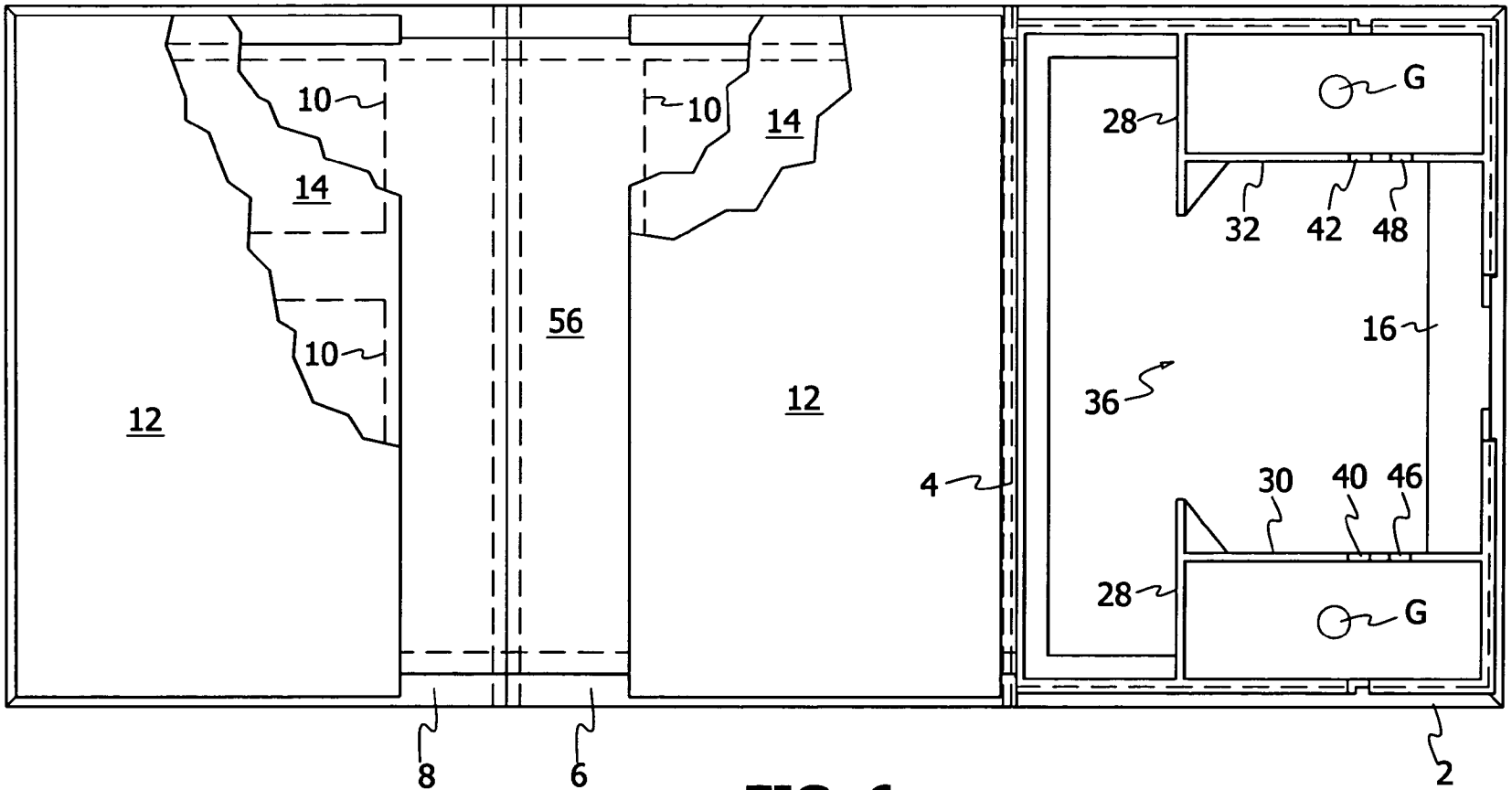
FIG. 6 is a top plan view of the desk accessory with portions shown in phantom lines and other portions broken away.

In loading the calendars or pictures or photos 14 in the pockets P, the loading position of the first cover panel 6 and the second cover panel 8 is in substantial horizontal position as illustrated in FIGS. 5 and 6. Pocket openings 52, 54 and 56 are accessible when the first cover panel 6 and the cover panel 8 are substantially horizontal when positioned.

Figure 7:
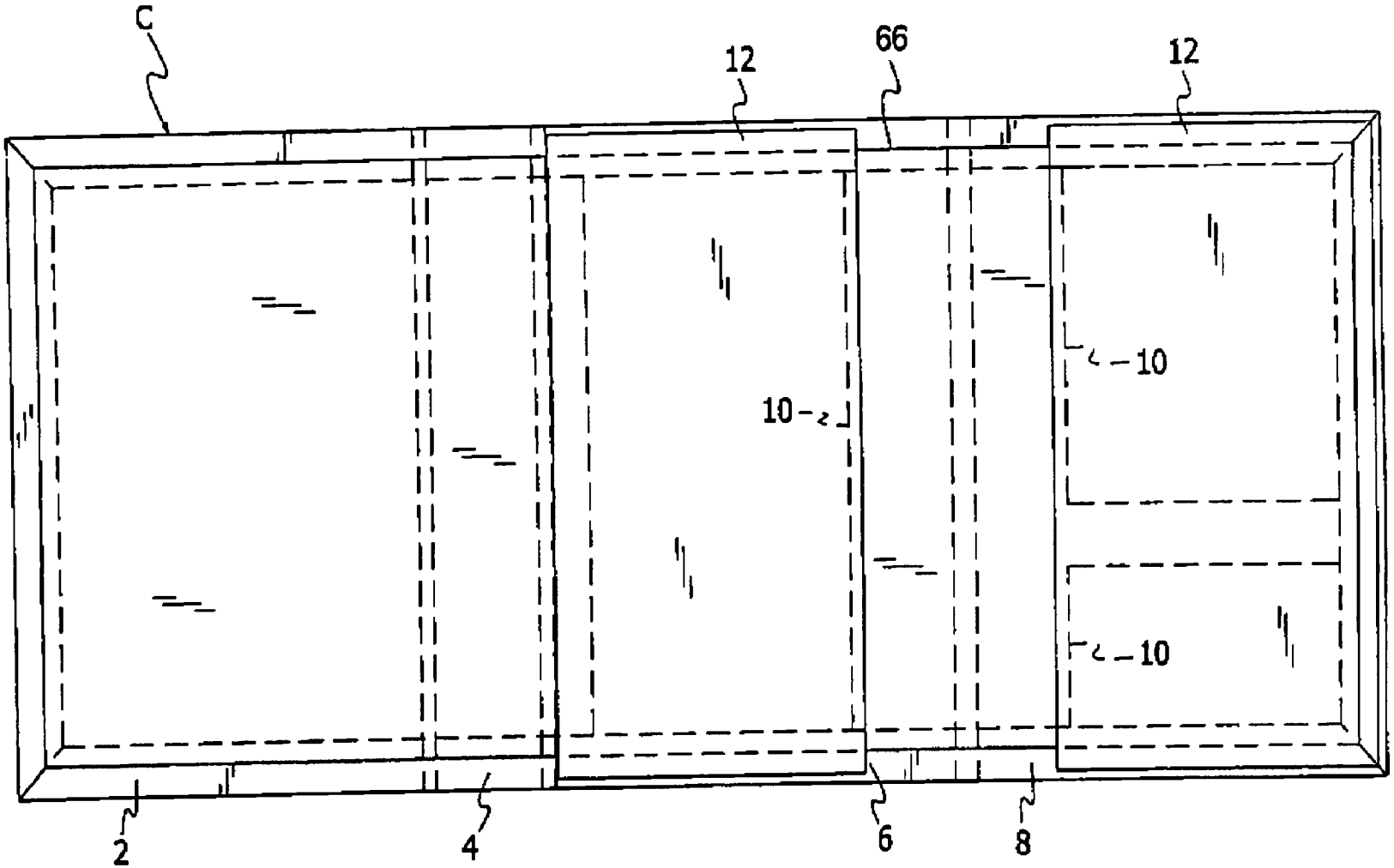
FIG. 7 is a top plan view of the cover prior to mounting on the tray.

FIG. 7 shows the cover C prior to having the pockets P and the tray T positioned thereon. A decorative cover sheet 66 is adhesively secured to the cover C as best shown in FIG. 7.

It is to be noted that the pocket P of the first cover panel 6 and the pocket P in the second cover panel 8, have openings 52 and 54 at the top of the pocket being closed at the bottom and sides. In the second display item loading and unloading position, the first cover panel pocket open top 52 faces the second cover panel pocket open top 54 and said pockets P are in second display item loading and unloading position.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A combination desk accessory tray and picture and calendar display item easel comprising:

a) a tray cover having a bottom panel, a rear side panel, a first cover panel and a second cover panel;

b) said first and second cover panels having a first tray cover position, a second display item loading and unloading position, and a third tray easel position;

c) said panels each having outer and inner sides;

d) a tray having a bottom, front, rear and side walls and an open top;

e) said tray bottom wall mounted on said inner side of said bottom panel of said tray cover;

f) said tray rear wall engageable with said inner side of said rear side panel of said tray cover;

g) said second cover panel foldable on said first cover panel so that when folded said second cover panel has its inner side engaged with said first cover panel inner side and said first and second cover panels are in said first tray cover position;

h) said first and second panels' inner side being spaced horizontally from each other when in said second display item loading and unloading position;

i) said first and second cover panels spaced angularly with respect to each other when in said third easel position;

j) said tray having easel positioning device for said first and second cover panels;

k) said first and second cover panels having windows; and l) said first and second cover panels each having a backing secured to its inner wall forming a pocket with said inner wall for receiving a display item; and each of said backing align with its window for displaying said display item when said first and second panels are in said third easel position.

2. A combination desk accessory tray and picture and calendar display item easel as in claim 1, and wherein:

a) said tray includes compartments.

3. A combination desk accessory tray and picture and calendar display item easel as in claim 2, and wherein:

a) said tray includes note paper receiving device; and b) said tray includes a cut-out for ease in access to note paper positioned in said note paper receiving device.

4. A combination desk accessory tray and picture and calendar display item easel as in claim 3, and wherein:

a) said cut-out is in said tray front.

5. A combination desk accessory tray and picture and calendar display item easel as in claim 2, and wherein:

a) said tray includes magnets positioned in at least one of said compartments for retaining metallic items.

6. A combination desk accessory tray and picture and calendar display item easel as in claim 2, and wherein:

a) said tray is a paper material.

7. A combination desk accessory tray and picture and calendar display item easel as in claim 2, and wherein:

a) said tray is a molded plastic material.

8. A combination desk accessory tray and picture and calendar display item easel as in claim 7, and wherein:

a) said tray cover is bonded at said tray bottom and rear walls of said tray.

9. A combination desk accessory tray and picture and calendar display item easel as in claim 2, and wherein:

a) said tray cover is of plastic material bonded to paper material.

10. A combination desk accessory tray and picture and calendar display item easel as in claim 2, and wherein:

a) said tray includes writing instrument holding device.

11. A combination desk accessory tray and picture and calendar display item easel as in claim 2, and wherein:

a) said easel positioning device includes easel notches in at least said tray side walls.

12. A combination desk accessory tray and picture and calendar display item easel as in claim 11, and wherein:

a) said tray includes inner compartment walls having easel notches corresponding to said tray side wall easel notches.

13. A combination desk accessory tray and picture and calendar display item easel as in claim 12, and wherein:

a) said writing instrument holding device are notches in advance of said easel side wall notches.

14. A combination desk accessory tray and picture and calendar display item easel as in claim 1, and wherein:

a) at least one of said first and second cover panels includes a plurality of windows.

15. A combination desk accessory tray and picture and calendar display item easel as in claim 1, and wherein:

a) said first cover panel pocket and said second cover panel pocket each have a closed bottom and sides and an open top.

16. A combination desk accessory tray and picture and calendar display item easel as in claim 15, and wherein:

a) said first cover panel pocket open top faces said second cover panel pocket open top and said pockets are in said second display item loading and loading position.

17. A combination desk accessory tray and picture and calendar display item easel as in claim 16, and wherein:

a) said first cover panel pocket open top and said second cover panel open top are blocked when said first and second cover panels are in first tray cover and third tray easel positions to prevent removal of display items positioned in said pockets.

* * * * *